US008400059B2

(12) United States Patent
Voronov et al.

(10) Patent No.: US 8,400,059 B2
(45) Date of Patent: Mar. 19, 2013

(54) MERCURY-VAPOR DISCHARGE LAMP FOR HOMOGENEOUS, PLANAR IRRADIATION

(75) Inventors: Alex Voronov, Hanau (DE); Burkard Jung, Alzenau (DE); Franz-Josef Schilling, Freigericht (DE)

(73) Assignee: Heraeus Noblelight GmbH, Hanau (DE)

( * ) Notice: Subject to any disclaimer, the term of this patent is extended or adjusted under 35 U.S.C. 154(b) by 0 days.

(21) Appl. No.: 13/181,916

(22) Filed: Jul. 13, 2011

(65) Prior Publication Data

US 2012/0032586 A1 Feb. 9, 2012

(30) Foreign Application Priority Data

Aug. 4, 2010 (DE) ..... 10 2010 033 446

(51) Int. Cl.
*H01J 17/02* (2006.01)
*H01J 61/02* (2006.01)

(52) U.S. Cl. ..... 313/610; 313/573; 313/609; 313/634

(58) Field of Classification Search ..... 313/567, 313/571, 573, 578, 609–611, 317, 634
See application file for complete search history.

(56) References Cited

U.S. PATENT DOCUMENTS 1,870,147 A * 8/1932 Smally ..... 362/216
2,102,049 A * 12/1937 Warren ..... 445/24
2,326,773 A 8/1943 Floyd
2,491,847 A * 12/1949 Breadner et al. ..... 313/317
3,226,590 A * 12/1965 Christy ..... 313/493
3,237,042 A * 2/1966 Martyny et al. ..... 313/623
3,243,630 A * 3/1966 Martyny ..... 313/493
(Continued)

FOREIGN PATENT DOCUMENTS

DE 3437212 A1 4/1986
DE 243140 A1 2/1987
(Continued)

OTHER PUBLICATIONS

Office Action issued Apr. 13, 2011 in DE Application No. 10 2010 033 446.4-54.

(Continued)

*Primary Examiner* — Anne Hines
*Assistant Examiner* — Jose M Diaz
(74) *Attorney, Agent, or Firm* — Panitch Schwarze Belisario & Nadel LLP

(57) ABSTRACT

Known mercury-vapor discharge lamps for planar irradiation are provided with a lamp bulb made of quartz glass, which encloses a closed discharge space having a non-linear gas-discharge channel. In order to provide a structurally simple lamp, which also guarantees a highest possible homogeneity of the UV irradiation, even for a small distance to the surface to be treated, the lamp bulb is formed as a quartz-glass chamber defined by straight walls and having bottom, top, and side walls and is divided into sub-chambers by several separating webs made of quartz glass and projecting from the bottom wall to the top wall. These sub-chambers include a front-most sub-chamber and a rear-most sub-chamber and form in series interconnection the non-linear gas-discharge channel. The separating webs extend alternately from one side wall up to close to the opposite side wall, while leaving open a gap connecting adjacent sub-chambers in a fluid-communicating manner. One electrode is allocated to the front-most sub-chamber and the other electrode is allocated to the rear-most sub-chamber.

16 Claims, 2 Drawing Sheets

U.S. PATENT DOCUMENTS

| | | | | |
|---|---|---|---|---|
| 3,247,415 | A * | 4/1966 | Martyny | 313/493 |
| 3,258,630 | A * | 6/1966 | Scott | 313/493 |
| 3,300,633 | A * | 1/1967 | Grimes | 362/263 |
| 3,395,301 | A * | 7/1968 | Iannelli | 313/25 |
| 3,646,383 | A * | 2/1972 | Jones et al. | 313/493 |
| 4,839,555 | A * | 6/1989 | O'Mahoney | 313/493 |
| 5,466,990 | A | 11/1995 | Winsor | |
| 5,479,069 | A * | 12/1995 | Winsor | 313/493 |
| 5,536,999 | A * | 7/1996 | Winsor | 313/493 |
| 5,808,410 | A * | 9/1998 | Pinker et al. | 313/493 |
| 5,818,164 | A * | 10/1998 | Winsor | 313/493 |
| 5,850,122 | A * | 12/1998 | Winsor | 313/493 |
| 6,011,354 | A * | 1/2000 | Tsai et al. | 313/634 |
| 6,218,776 | B1 * | 4/2001 | Cull et al. | 313/493 |
| 6,307,320 | B1 * | 10/2001 | Fuse et al. | 313/634 |
| 6,373,185 | B1 * | 4/2002 | Tyler | 313/491 |
| 6,486,598 | B1 | 11/2002 | Tsai et al. | |
| 6,559,599 | B1 * | 5/2003 | Cooch et al. | 313/634 |
| 6,731,058 | B1 | 5/2004 | Kincade | |
| 7,327,093 | B2 * | 2/2008 | Hur et al. | 315/219 |
| 7,375,469 | B2 * | 5/2008 | Chou et al. | 313/631 |
| 7,385,342 | B2 * | 6/2008 | Eom | 313/491 |
| 2004/0051454 | A1 * | 3/2004 | Sauska et al. | 313/567 |
| 2005/0253513 | A1 * | 11/2005 | Park et al. | 313/581 |
| 2007/0188099 | A1 * | 8/2007 | Kim et al. | 313/610 |

FOREIGN PATENT DOCUMENTS

| | | | |
|---|---|---|---|
| DE | 9108294 | U1 | 10/1991 |
| DE | 202008017007 | U1 | 7/2009 |
| EP | 0052500 | B1 | 5/1982 |
| WO | 9534087 | A1 | 12/1995 |

OTHER PUBLICATIONS

Office Action issued Nov. 29, 2012 in EP Application No. 11005665.2.

Hicks et al, "Development of a new lamp technology for backlight LCDs", SID International Symposium—Digest of Technical Papers, pp. 21-24 (May 16-21, 1993).

* cited by examiner

MERCURY-VAPOR DISCHARGE LAMP FOR HOMOGENEOUS, PLANAR IRRADIATION

BACKGROUND OF THE INVENTION

The invention relates to a mercury-vapor discharge lamp for a homogeneous, planar irradiation, having a lamp bulb made of quartz glass, which encloses a closed discharge space into which two electrodes project, with a non-linear gas discharge channel extending between these electrodes.

UV emitters, such as mercury-vapor discharge lamps, are used, for example, for purifying or modifying the surfaces of substrates, or for the sterilization or activation of surfaces. Typically, processing is performed here with UV light in the wavelength range of 160 to 400 nm.

For a high productivity production line, a high UV light intensity is required in the area of the surface to be processed. The homogeneity of the UV irradiation is often of decisive importance for the irradiation result, especially for applications in which the surface to be irradiated is not moved relative to the UV emitter.

For a high UV light intensity, a smallest possible distance between the surface and UV emitter is advantageous. On the other hand, a small distance makes homogeneous illumination more difficult, because the UV radiation intensity is inhomogeneous in the near field of the emitter.

For generating a planar irradiation, UV emitters are known, for example, from German published patent application DE 34 37 212 A1 and German utility model DE 91 08 294 U1, in which the lamp bulb is bent into a U shape or meander shape or is assembled from tube parts which as a whole have a U-shaped or meander-shaped profile.

A lamp bulb folded into a meander shape, however, cannot be easily folded without interruption, so that gaps are created between the legs of the meander, which negatively affect the homogeneity of the light distribution.

In an alternative embodiment, in which several elongated UV emitters are arranged parallel to each other and in a common plane, an essentially homogeneous radiation field can indeed be achieved. However, such emitter arrangements are associated with high assembly and adjustment expense, and the multitude of lamps and ballasts also require high structural expense. In addition, upon failure of only a single emitter, often the entire emitter set must be exchanged, in order to avoid inhomogeneities due to different aging processes of the emitters.

BRIEF SUMMARY OF THE INVENTION

The invention is therefore based on the object of providing a structurally simple mercury-vapor discharge lamp, which also guarantees a highest possible homogeneity of the UV irradiation even with a small distance to the surface to be treated.

This object is achieved according to the invention starting with a mercury-vapor discharge lamp having the features of the type of device mentioned above, in that the lamp bulb is formed as a quartz-glass chamber defined by straight walls and having bottom, top, and side walls and is divided into sub-chambers by several separating webs made of quartz glass and extending from the bottom to the top, wherein these sub-chambers comprise a front-most sub-chamber and a rear-most sub-chamber and form, in series interconnection, the non-linear gas-discharge channel, wherein the separating webs extend alternately from one side wall up to close to the opposite side wall, while leaving open a gap connecting adjacent sub-chambers in a fluid-communicating manner, and wherein one electrode is allocated to the front-most sub-chamber and the other electrode is allocated to the rear-most sub-chamber.

The mercury-vapor discharge lamp according to embodiments of the invention consists essentially of a quartz-glass chamber having an arbitrary cross section, which can be easily adapted to the geometry of the surface to be treated, thus for example round, rectangular, or triangular. The cross-sectional geometry is produced by the geometry of the top and the bottom walls, wherein the bottom wall simultaneously forms the emitter surface.

The top and bottom walls are connected to each other by straight side walls, so that a closed, cylindrical quartz-glass chamber is produced. The height of the side walls corresponds to the distance between the top and bottom walls.

The quartz-glass chamber is divided into at least three sub-chambers, which form, in series interconnection, a non-linear, labyrinth-shape, winding gas-discharge channel. To this end, at least two separating webs are provided, which extend across the entire height of the quartz-glass chamber and run alternately from one side wall up to close to an opposite side wall, and here leave open a gap between the adjacent sub-chambers.

The gas-discharge channel runs from the front-most sub-chamber to the rear-most sub-chamber, wherein either one of the electrodes projects directly into each of these sub-chambers or these sub-chambers are connected in a fluid-communicating manner to another space into which the electrode projects.

The series interconnection of the sub-chambers completely fills the quartz-glass chamber and forms the gas-discharge channel. Therefore, a homogeneous irradiation intensity is set across the emission surface—apart from narrow regions around the separating webs.

The quartz-glass chamber, including the separating webs, is assembled from simple quartz-glass parts. It is simple to produce and requires only a single electrical connection and only a small expense for assembly and adjustment.

Especially with respect to a simple construction, it has proven beneficial if the front-most and the rear-most sub-chambers each have an opening, which is connected to one end of a quartz-glass tube in which an electrode is arranged, whose power connection is guided out of the quartz-glass tube via a gas-tight, pinched section on the opposite end.

The electrodes are here not connected directly to the corresponding sub-chambers at the beginning and at the end of the gas-discharge channel, but instead to separate quartz-glass tubes, of which one end is provided with a pinched section for the gas-tight bushing of the power connection for the electrodes. The quartz-glass tube provided with the electrodes then must only be welded to the quartz-glass chamber. This simplifies the production of the mercury-vapor discharge lamp according to the invention.

In this context, it has proven especially effective when the quartz-glass tube is a round tube. The introduction of electrodes into round tubes by gas-tight bushings is standard technology.

The quartz-glass tubes can be connected to a side wall of the quartz-glass chamber. An especially compact construction is produced, however, when the quartz-glass tubes are connected to the top wall of the quartz-glass chamber.

An embodiment of the mercury-vapor discharge lamp according to the invention is preferred in which the quartz-glass tube is made of quartz glass containing a dopant that causes absorption for VUV radiation of wavelengths around 185 nm.

The quartz-glass tube (or the quartz-glass tubes) usually extends in the direction opposite the direction of emission and does not contribute to the UV treatment. To the contrary, the quartz-glass tube can extend into regions and spaces in which the emission of high-energy UV light is undesired, whether due to ozone formation or due to UV aging of adjacent components, as for example seals made of plastic.

Suitable dopants for the absorption of VUV radiation are, for example, titanium oxide and gallium oxide.

An especially simple construction of the mercury-vapor discharge lamp according to the invention is distinguished in that the top and the bottom walls of the quartz-glass chamber have polygonal constructions and the sub-chambers have square-shaped constructions.

In the region of the separating webs, a certain drop in UV intensity is produced across the emission surface. Therefore, the separating webs are as thin as possible and only as thick as necessary, as the mechanical stability demands. Here, it has proven effective when the separating webs have a thickness in the range of 1 to 3 mm, preferably a maximum of 2 mm.

In the structurally simplest case, the separating webs are constructed as flat quartz-glass plates and are spot-welded onto the bottom wall and onto the top wall of the quartz-glass chamber.

The separating webs are not welded continuously to the top and the bottom walls, but instead only spot-welded at a few points. This simplifies the production of the mercury-vapor discharge lamp and prevents deformation due to the welding process. The separating webs here indeed do not separate adjacent sub-chambers in a gas-tight manner from each other; it has been shown, however, that a gas-tight separation is also not necessary. Thus, a discharge in a narrow gap between the separating web and the top or the bottom wall is energetically disfavored, so that the discharge follows the intended gas-discharge channel.

A construction of the mercury-vapor discharge lamp according to the invention is preferred in which the sub-chambers extend along a longitudinal axis, wherein their width dimension perpendicular to the longitudinal axis equals in the range of 5 to 20 mm, preferably less than 15 mm.

The sub-chambers here have an elongated construction and extend, in the simplest case, from one side wall to the opposite side wall. The height of the sub-chambers is given by the spacing of the top and bottom walls, and their width—the dimension perpendicular to the height dimension and longitudinal axis—lies in a range in which an optimal filling by the gas discharge is produced. With widths of greater than 20 mm, the gas discharge does not completely fill the sub-chambers and with widths of less than 5 mm, for the specified dimensions of the emission surface, many separating web walls are required with correspondingly high structural expense.

With respect to a most optimal possible filling of the sub-chambers by the gas discharge, it has also proven advantageous when the distance between the top and bottom walls lies in the range of 5 to 20 mm, preferably less than 15 mm.

In the simplest case, the sub-chambers have a meander-shaped profile along their series interconnection.

For increasing the radiation intensity available in the region of the emission surface, it is advantageous when the top wall of the quartz-glass chamber is provided with a reflector. Thereby, the radiation portion emitted in the direction of the top wall is not lost at all or lost only in a small amount. For the same reason, it is also beneficial to provide the side walls with a reflector.

The reflector could involve a separate reflector component. In an especially preferred way, however, the reflector is constructed in the form of a coating of the top wall, as for example in the form of a layer made of opaque quartz glass, which acts as a diffuse reflector.

The quartz-glass chamber can be made of synthetically generated quartz glass and/or from quartz glass melted from naturally occurring material. An embodiment in which the bottom wall is made of synthetically generated quartz glass has proven especially effective. Synthetically generated quartz glass distinguishes itself by a high purity and an especially high transmission for UV radiation, especially in the wavelength region around 185 nm.

For applications with a sensitive surface, a low-pressure mercury lamp having a nominal output of less than 100 W is preferably used as the mercury-vapor discharge lamp.

Low-pressure mercury lamps provide excellent efficiency. Approximately 40% of the electrical power is converted into UVC radiation at 254 nm and approximately 10% into VUV radiation at 185 nm. However, sensitive surfaces can be negatively affected by a smaller distance to the emission surface of the UV emitter, which can be minimized by a low lamp output.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
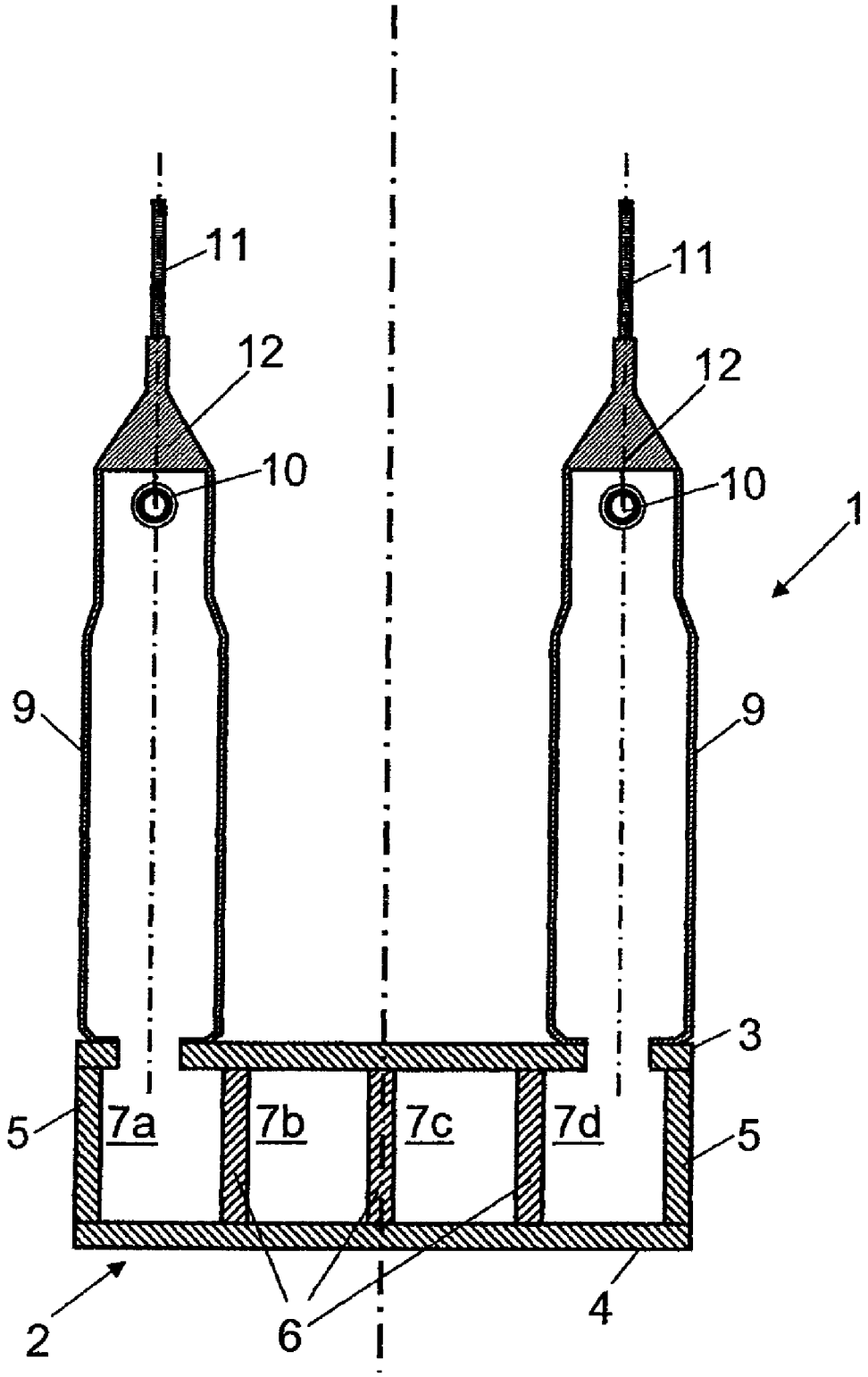
FIG. 1 is a front cross-sectional view of an embodiment of the mercury-vapor discharge lamp according to the invention.

The mercury-vapor discharge lamp according to FIG. 1 is used for the purification of static, non-moving substrates in a microscope unit. The VUV radiation here causes a decomposition of organic impurities at the molecular level. The distance between the substrate surface and the mercury-vapor discharge lamp lies in the range of a few millimeters, so that high demands are placed on the homogeneity of the UV irradiation.

The device used here comprises a low-pressure mercury lamp 1 designed for a nominal output of 50 W. The low-pressure mercury lamp 1 comprises a square-shaped, quartz-glass chamber 2, which is produced by the gas-tight welding of a square cover plate 3, a square base plate 4, and four identical side walls 5. Their lateral dimension equals 60 mm and their height 15 mm.

The base plate 4 forming the emission surface, by which the working radiation is discharged onto the substrate, comprises synthetically generated quartz glass. The cover plate 3 and the side walls 5 comprise quartz glass, which is melted from naturally occurring material.

The inner space of the quartz-glass chamber 2 is divided by three separating webs 6, which have the same height as the side walls 5, into four elongated, block-shaped sub-chambers 7*a*, 7*b*, 7*c*, 7*d* running parallel to each other. The thickness of the separating webs 6 equals 2 mm and they are likewise made of quartz glass, which is melted from naturally occurring material.

Figure 3:
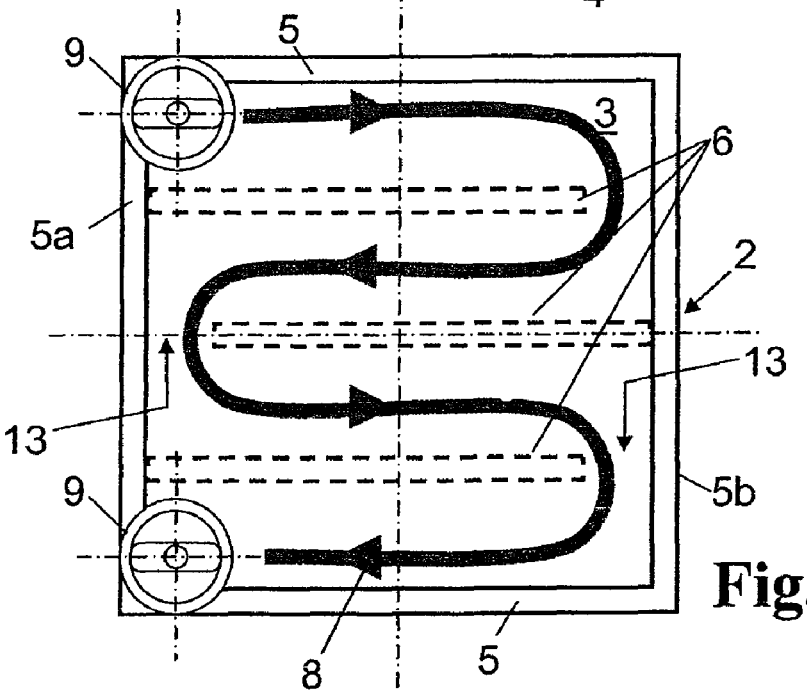
FIG. 3 is a top cross-sectional view of the mercury-vapor discharge lamp according to FIG. 1.

From the top view of FIG. 3 it can be seen that the separating webs 6 here extend alternately from one side wall 5*a* up to close to the opposite side wall 5*b* (and vice versa, from the side wall 5*b* up to close to the opposite side wall 5*a*), so that the inner space represents overall a meander-shaped gas-discharge channel, which is formed from the series interconnection of the sub-chambers 7*a*, 7*b*, 7*c*, 7*d*. The gas-discharge channel is symbolized in FIG. 3 by the directional arrow 8. The individual sub-chambers 7*a*, 7*b*, 7*c*, 7*d* extend along a longitudinal axis and have a length of approximately 56 mm and a width of approximately 12.5 mm.

The separating webs 6 are each spot-welded at three points onto the cover plate 3 and onto the attaching side wall (5*a* or 5*b*). Their length is designed so that a gap 13 having a gap width of approximately 7 mm is left open to the opposite side wall, wherein this gap represents a fluid connection between each of the adjacent sub-chambers 7*a*, 7*b*, 7*c*, 7*d*.

The sub-chamber 7*a* forms the beginning of the gas-discharge channel 8 and the sub-chamber 7*d* its end. The beginning and end lie on one and the same side wall 5*a*. In the region of these sub-chambers 7*a*, 7*d*, the cover plate 3 is provided with an opening, which is closed with a welded round tube 9 made of a quartz glass doped with $TiO_2$ and having an outer diameter of 15 mm. In the round tubes 9 are mounted electrodes 10, whose power supply 11 is guided out from the round tubes 9 via pinched sections 12.

Figure 2:
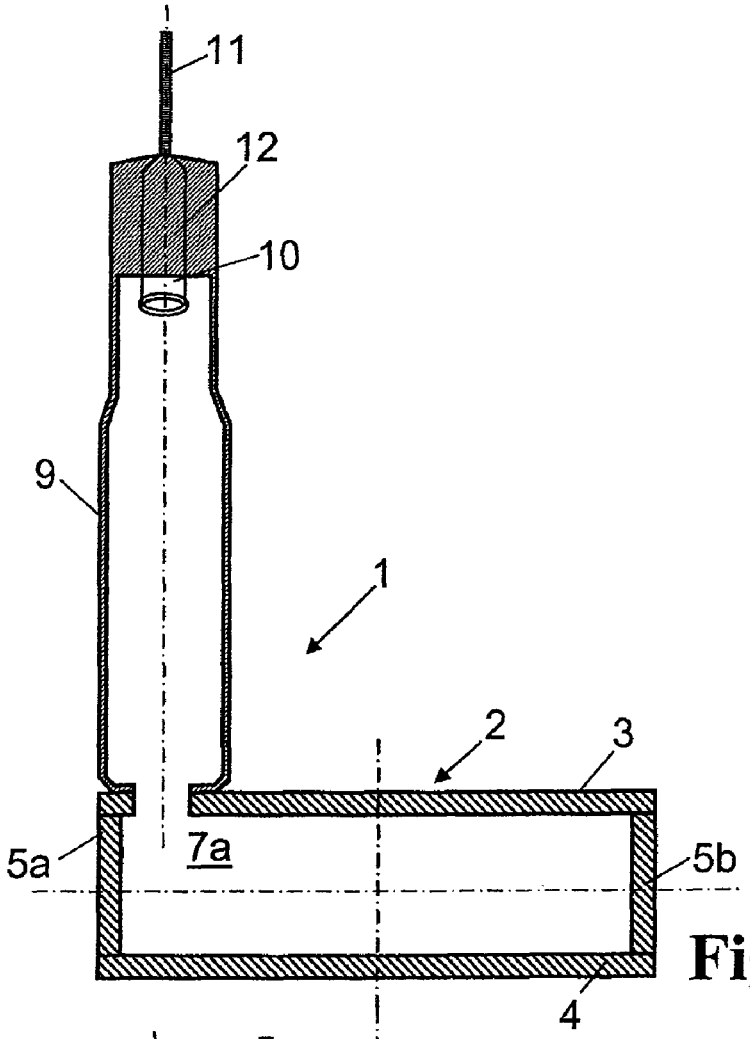
FIG. 2 is a side cross-sectional view of the mercury-vapor discharge lamp according to FIG. 1.

From the side view of FIG. 2 it can be seen that the round tubes 9, together with the electrodes 10 inserted therein, are each connected onto the cover plate 3 in the region of the side wall 5*a*. The gas discharge takes place over the entire section between the electrodes 10, thus even within the round tubes 9, wherein this part of the gas discharge, however, does not contribute to the irradiation of the substrate and is not taken into account in the gas-discharge channel 8.

The cover plate 3 and the side parts 5 are each provided on their outer side with a layer (not shown) made of opaque quartz glass, which acts as a diffuse reflector.

The mercury-vapor discharge lamp 1 according to this embodiment of the invention is made of simple components, and it allows an especially homogeneous UV irradiation even in the near field. Thus, with the same side dimensions, this construction allows four sub-chambers 7*a*, 7*b*, 7*c*, 7*d* in contrast to only three legs for a meander-shaped folding of the lamp bulb.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A mercury-vapor discharge lamp for homogeneous, planar irradiation, comprising a lamp bulb made of quartz glass, the lamp bulb encloses a closed discharge space into which two electrodes (10) project and defines a non-linear gas-discharge channel (8) extending between the electrodes, wherein the lamp bulb is formed as a quartz-glass chamber (2) defined by straight walls including bottom (4), top (3) and side walls (5, 5*a*; 5*b*), the chamber being divided into sub-chambers (7*a*; 7*b*; 7*c*; 7*d*) by a plurality of separating webs (6) projecting from the bottom wall (4) to the top wall (3), the separating webs (6) comprising quartz glass plates spot-welded onto the bottom wall (4) and onto the top wall (3) of the quartz glass chamber, wherein the sub-chambers comprise a front-most sub-chamber (7*a*) and a rear-most sub-chamber (7*d*) and form in series interconnection the non-linear gas-discharge channel (8), wherein the separating webs (6) extend alternately from one of the side wall (5*a*) up to close to an opposite one of the side walls (5*b*) while leaving open a gap (13) connecting adjacent ones of the sub-chambers in a fluid-communicating manner, and wherein one of the electrodes (10) is allocated to the front-most sub-chamber (7*a*) and another of the electrodes (10) is allocated to the rear-most sub-chamber (7*d*).

2. The mercury-vapor discharge lamp according to claim 1, wherein the front-most sub-chamber (7*a*) and the rear-most sub-chamber (7*d*) each have an opening connected to one end of a quartz-glass tube (9) in which one of the electrodes (10) is arranged, and wherein a power connection (11) for the one electrode is guided out of the quartz-glass tube (9) via a gas-tight, pinched section (12) at an opposite end of the quartz-glass tube.

3. The mercury-vapor discharge lamp according to claim 2, wherein the quartz-glass tube (9) is a round tube.

4. The mercury-vapor discharge lamp according to claim 2, wherein each of the quartz-glass tubes (9) is connected to the top wall (3) of the quartz-glass chamber (2).

5. The mercury-vapor discharge lamp according to claim 1, wherein the top wall (3) and the bottom wall (4) of the quartz-glass chamber (2) have polygonal constructions, and wherein the sub-chambers (7*a*; 7*b*; 7*c*; 7*d*) have square-shaped constructions.

6. The mercury-vapor discharge lamp according to claim 1, wherein the separating webs (6) have a thickness in a range of 1 to 3 mm.

7. The mercury-vapor discharge lamp according to claim 6, wherein the separating webs (6) have a maximum thickness of 2 mm.

8. The mercury-vapor discharge lamp according to claim 1, wherein the sub-chambers (7*a*; 7*b*; 7*c*; 7*d*) extend along a longitudinal axis and have a width dimension perpendicular to the longitudinal axis in a range of 5 to 20 mm.

9. The mercury-vapor discharge lamp according to claim 8, wherein the width dimension perpendicular to the longitudinal axis is less than 15 mm.

10. The mercury-vapor discharge lamp according to claim 1, wherein a distance between the top wall (3) and the bottom wall (4) is in a range of 5 to 20 mm.

11. The mercury-vapor discharge lamp according to claim 10, wherein the distance between the top wall (3) and the bottom wall (4) is less than 15 mm.

12. The mercury-vapor discharge lamp according to claim 1, wherein the sub-chambers (7*a*; 7*b*; 7*c*; 7*d*) run in a meander shape along their series interconnection.

13. The mercury-vapor discharge lamp according to claim 1, wherein the top wall (3) of the quartz-glass chamber is provided with a reflector.

14. The mercury-vapor discharge lamp according to claim 1, wherein the bottom wall comprises synthetically generated quartz glass.

15. The mercury-vapor discharge lamp according to claim 1, wherein the mercury-vapor discharge lamp is a low-pressure mercury lamp having a nominal output of less than 100 W.

16. A mercury-vapor discharge lamp for homogeneous, planar irradiation, comprising a lamp bulb made of quartz glass, the lamp bulb encloses a closed discharge space into which two electrodes (10) project and defines a non-linear gas-discharge channel (8) extending between the electrodes, wherein the lamp bulb is formed as a quartz-glass chamber (2) defined by straight walls including bottom (4), top (3) and side walls (5, 5*a*; 5*b*), the chamber being divided into sub-chambers (7*a*; 7*b*; 7*c*; 7*d*) by a plurality of separating webs (6) made of quartz glass and projecting from the bottom wall (4) to the top wall (3), wherein the sub-chambers comprise a front-most sub-chamber (7*a*) and a rear-most sub-chamber (7*d*) and form in series interconnection the non-linear gas-discharge channel (8), wherein the separating webs (6) extend alternately from one of the side wall (5*a*) up to close to an opposite one of the side walls (5*b*) while leaving open a gap (13) connecting adjacent ones of the sub-chambers in a fluid-communicating manner, and wherein one of the electrodes (10) is allocated to the front-most sub-chamber (7*a*) and another of the electrodes (10) is allocated to the rear-most sub-chamber (7*d*), wherein the front-most sub-chamber (7*a*) and the rear-most sub-chamber (7*d*) each have an opening connected to one end of a quartz-glass tube (9) in which one of the electrodes (10) is arranged, and wherein a power connection (11) for the one electrode is guided out of the quartz-glass tube (9) via a gas-tight, pinched section (12) at an opposite end of the quartz-glass tube and wherein the quartz-glass tube (9) comprises quartz glass containing a dopant causing an absorption for VUV radiation of a wavelength around 185 nm.

* * * * *